US005884480A

United States Patent [19]

Dahl et al.

[11] Patent Number: 5,884,480

[45] Date of Patent: Mar. 23, 1999

[54] FLUID POWER CONTROL CIRCUIT

[75] Inventors: Thomas Dahl, Spanga; Sten Frodin, Jarfalla, both of Sweden

[73] Assignee: Trinova Limited, United Kingdom

[21] Appl. No.: 822,454

[22] Filed: Mar. 21, 1997

[30] Foreign Application Priority Data

Mar. 23, 1996 [GB] United Kingdom ..... 9606186

[51] Int. Cl.[6] ..... F16D 31/02

[52] U.S. Cl. ..... 60/452; 60/445

[58] Field of Search ..... 60/445, 452

[56] References Cited

U.S. PATENT DOCUMENTS

| | | | |
|---|---|---|---|
| 4,468,173 | 8/1984 | Dantlgraber | 60/452 X |
| 4,627,238 | 12/1986 | Mayr et al. . | |
| 4,738,102 | 4/1988 | Kropp | 60/452 X |
| 5,095,697 | 3/1992 | Kauss | 60/452 |
| 5,697,764 | 12/1997 | Oda et al. | 60/452 X |

FOREIGN PATENT DOCUMENTS

| | | |
|---|---|---|
| 0439621A | 8/1991 | European Pat. Off. . |
| 0549883A | 7/1993 | European Pat. Off. . |
| 2291986 | 2/1996 | United Kingdom . |
| 2291987 | 2/1996 | United Kingdom . |

*Primary Examiner*—Hoang Nguyen
*Attorney, Agent, or Firm*—Barnes, Kisselle, Raisch, Choate, Whittemore & Hulbert P.C.

[57] ABSTRACT

In the field of fluid power control, there is a need for a control scheme that supplies working fluid under pressure to a load in the event of failure of power supplies to control apparatus associated with the circuit. The disclosure relates to a control circuit 10 in which output pressure from a pump 11 is fed to a control piston 13 therefor via a pressure compensator 17. The pressure compensator 17 is biased to disconnect the supply of fluid at outlet pressure when this pressure is below a threshold value, and permit such supply when the outlet pressure exceeds the threshold value determined by the biassing force on the pressure compensator. A proportional control valve 16 may be employed further to counteract the biassing of the pressure compensator 17, whereby to control the threshold pressure at which the compensator 17 operates to feed fluid at control pressure to the piston 13. The invention is of particular use in control circuits eg. for cooling pumps and cooling fans.

15 Claims, 4 Drawing Sheets

FLUID POWER CONTROL CIRCUIT

This invention relates to a fluid power control circuit.

In many engineering applications involving fluid power control circuits, there is a need for "failure safety" to cater for occasions when control signals in such circuits become lost or corrupted. An example of this arises in a control circuit for a fan or cooling pump intended to provide loading-dependent cooling, eg. for a component that would become damaged or dangerous if the pump or fan ceases to function.

Previous solutions to this problem have required complicated circuits.

It is also desirable to provide a simple control circuit capable of reacting in some other way, eg. by disconnecting power to a load device, on loss or corruption of control signals.

According to the invention there is provided a fluid power control circuit, comprising:

- a pump, connectable to supply fluid at outlet pressure to a load;
- an adjustable control device capable of supplying control fluid in the circuit;
- a fluid-actuated adjuster for adjusting the output of the pump; and
- a pressure-actuated directional controller for operatively supplying fluid at outlet pressure to the adjuster, wherein:
  - i) the directional controller is biassed to disconnect fluid at outlet pressure from the adjuster;
  - ii) fluid at outlet pressure acts on the directional controller to counter said bias; and
  - iii) control fluid in the circuit acts on the directional controller to counter said bias,
  - whereby fluid at outlet pressure is supplied to the adjuster when the aggregate effect of fluid at outlet pressure and control fluid on the directional controller exceeds its bias.

Optionally the supply of fluid at outlet pressure to the adjuster causes the adjuster to decrease the outlet flow, and thus the outlet pressure, of the pump.

When configured in this way, the apparatus of the invention provides a simple, convenient and reliable means of ensuring that eg. a pump or fan continues to function even if the control signals therefor are completely lost or corrupted with the result that fluid at outlet pressure is no longer supplied to the adjuster.

In other optional embodiments, the adjuster may of course be configured to react in some other way to the absence of fluid at supply pressure. For example, the absence of such fluid may cause a decrease rather than an increase in the outlet pressure of the pump.

Conveniently the directional controller is a pressure compensator including a moveable spool. This arrangement is advantageously simple and economical to manufacture.

Preferably the circuit includes resilient biassing means biassing the spool to disconnect the fluid at outlet pressure from the adjuster. However, other means of biassing the spool may optionally be employed.

Conveniently the fluid at outlet pressure acts on the spool against the bias of the directional controller. By judicious choice of the degree of biassing, the circuit can be arranged such that only a small pressure additional to the outlet pressure is needed to overcome the bias of the directional controller and permit the supply of fluid at outlet pressure to the adjuster whereby to alter the output of the pump.

Conveniently the directional controller includes a first, moveable surface against which control fluid in the circuit may act, against the bias of the directional controller to disconnect fluid at outlet pressure from the adjuster, the moveable surface being drivingly engageable with the spool.

This arrangement advantageously allows the use of fluid at control pressure to provide the small, additional pressure previously referred to to overcome the bias of the directional controller.

The moveable surface may optionally be integral with the spool, or, more preferably, separate therefrom.

Preferably the directional controller includes a moveable piston defining the first moveable surface at one side thereof, the said side of the piston being drivingly engageable with the spool; and the resilient biassing means acting on the opposite side of the piston.

This arrangement provides a convenient means by which fluid at outlet pressure and fluid at control pressure may cause the spool to move in the same direction, against the bias.

In preferred embodiments, the spool includes a further surface against which acts fluids at outlet pressure. The provision of separate surfaces for the outlet pressure and control pressure fluids confers an advantageously economical construction on a circuit according to the invention.

It is also preferable that the control device is a proportional control valve, in particular a solenoid actuated proportional control valve. Such a valve may readily be operatively connected to a settable member such as a dial or lever, permitting proportional control of the circuit by a user thereof.

Conveniently, the directional controller is a proportional device.

The invention is also considered to reside in a pressure control apparatus, eg. fan or pump motor control apparatus, including a circuit as defined hereinabove.

There now follows a description of preferred embodiments of the invention, by way of example, with reference to the accompanying drawings, in which.

Figure 1:
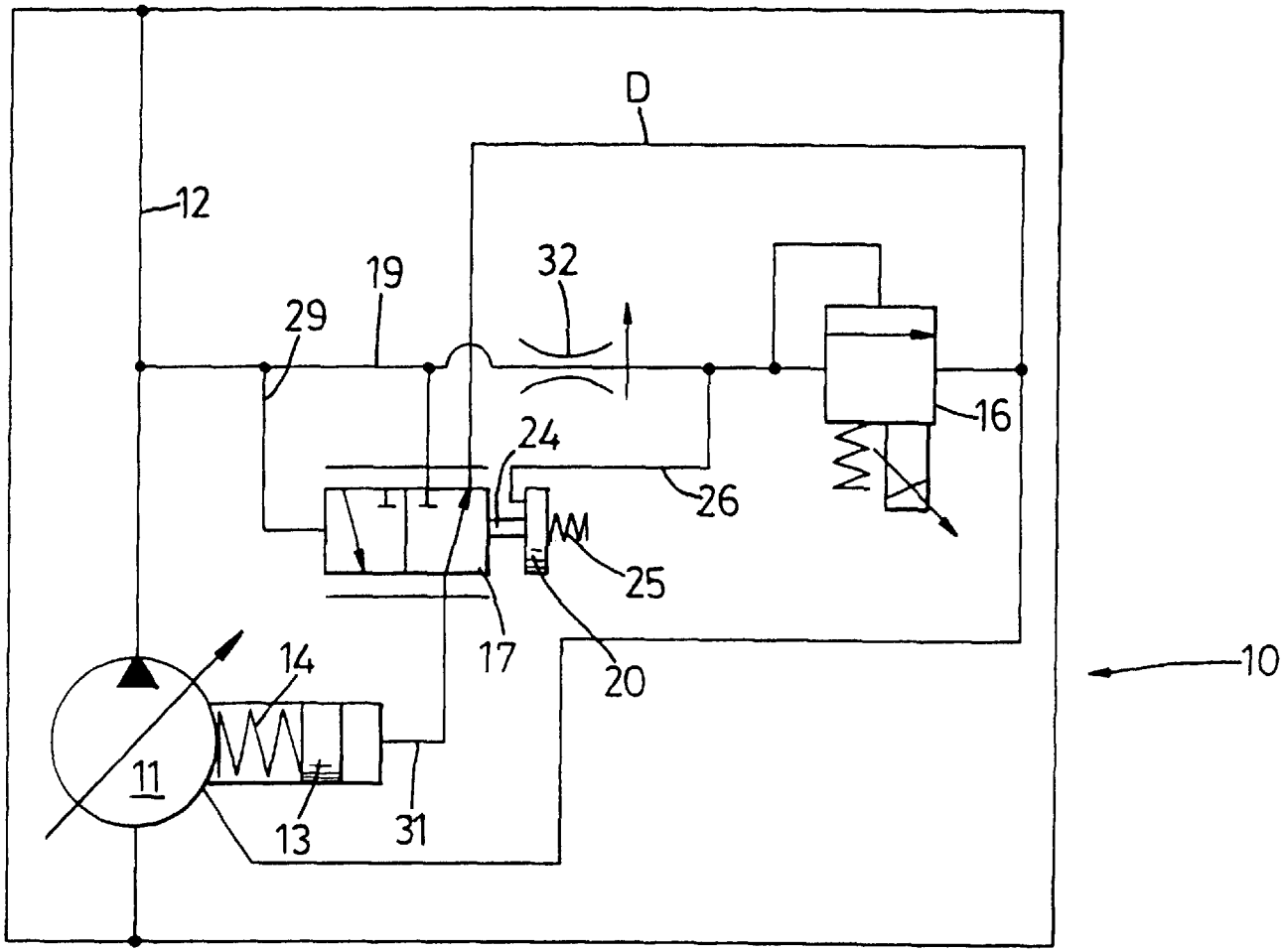
FIG. 1 is a schematic circuit diagram of one embodiment of the invention.

In the following description, the invention is described with reference to an hydraulic control circuit although it is possible to devise embodiments of the invention employing fluids other than hydraulic oil.

Referring to the drawings, there is shown an hydraulic control circuit 10 according to the invention.

Circuit 10 includes a variable outlet pump 11 capable of supplying fluid at outlet pressure via line 12 for use in a load (not shown).

Figure 4:
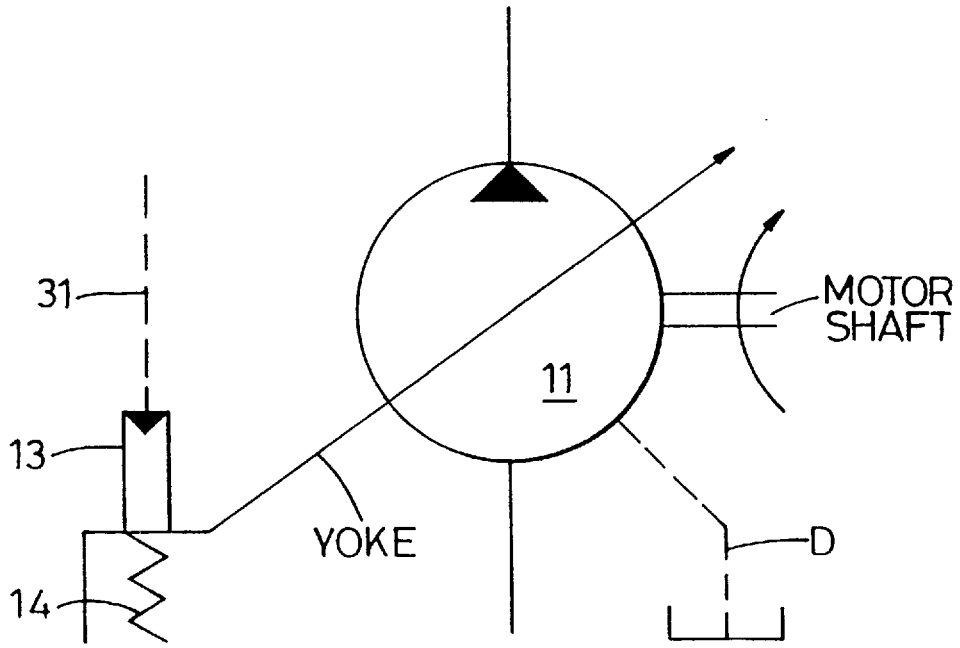
FIG. 4 is a schematic representation of part of the circuit of FIG. 1, in greater detail.

The outlet pressure of pump 11 is controlled by an adjuster in the form of control piston 13. Control piston 13 is biassed by a spring 14 to a position of minimum extension. Control piston 13 is such that as it extends towards pump 11 it causes a reduction in the outlet pressure in line 12. This is achieved eg. by a linkage directly or indirectly interconnecting piston 13 and the yoke of pump 11. This is shown schematically in FIG. 4. In practical embodiments, spring 14 lies within the housing 11 to allow for draining of the left hand side of control piston 13. The casing of pump 11 is connected to drain in a per se known manner.

Circuit 10 includes a conventional, solenoid actuated, proportional control valve 16 arranged to supply fluid at control pressure in the circuit, in dependence on the setting of eg. a lever or dial operatively connected to the solenoid thereof.

Circuit 10 also includes a proportional, pressure actuated, directional controller in the form of pressure compensator 17.

Pressure compensator 17 includes a moveable spool 18 (FIGS. 2 and 3) that in a first position connects the inlet side of control piston 13 to tank via drain line D and in a second position connects the inlet side of control piston 13 to fluid at outlet pressure tapped from line 12 via line 19.

Pressure compensator 17 includes a piston 20 that is reciprocable in a bore 22 (FIGS. 2 and 3) adjacent a bore 23 in which spool 18 is longitudinally slidable. Bore 23 is open ended adjacent bore 22, and a free end 24 of spool 18 protrudes beyond the end of bore 23 for engagement with the left hand side of piston 20 as shown in the drawing figures. Free end 24 and piston 20 are in mutual engagement with one another but are not secured together in the preferred embodiment.

Piston 20 is biassed towards the left hand side of the drawing figures by a resilient biassing means in the form of spring 25 acting longitudinally in bore 22.

Fluid at control pressure is supplied from control valve 16 via line 26 to the left hand side of piston 20. In other words, fluid at control pressure in the circuit tends to oppose the biassing effect of spring 25 on piston 20.

An adjustable screw 40 may be used as desired to alter the force provided by spring 25. This determines the pressure required at line 29 to cause movement of piston 20 as described below.

Spool 18 includes a plate 28 the left hand side of which in the drawing figures is supplied with fluid at outlet pressure via line 29. Thus, when the free end 24 of spool 18 is in contact with the left hand side of piston 20, fluid at outlet pressure acting on plate 28 also tends to overcome the biassing effect of spring 25. The bias would otherwise drive piston 20 and spool 18 to the left of the drawing figures.

Figure 2:
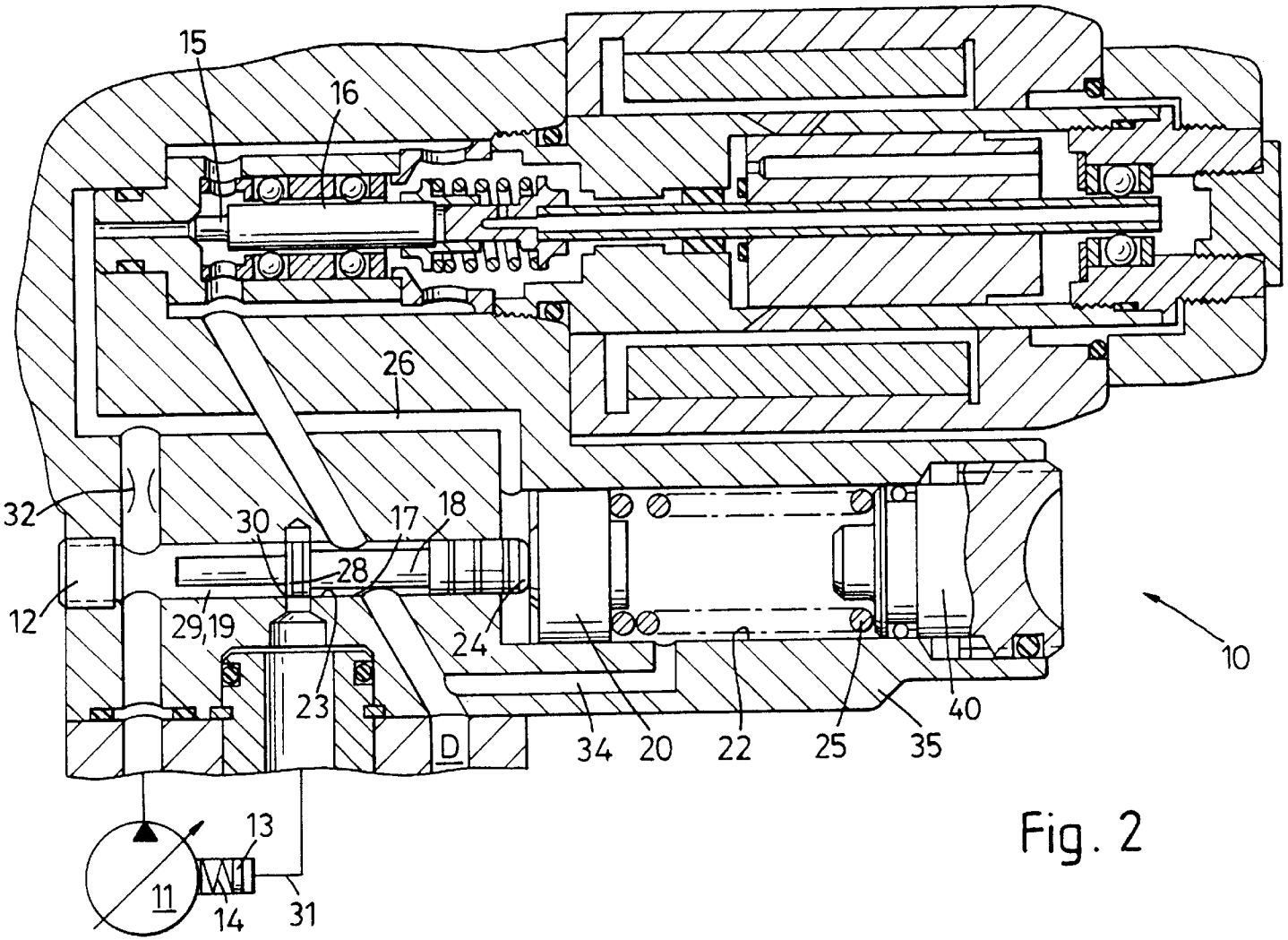
FIG. 2 is a cross-sectional view of apparatus according to the circuit of FIG. 1.

Plate 28 serves as a valve member for connecting line 19 to the inlet side of piston 13, thereby supplying the inlet side of piston 13 with fluid at outlet pressure. This is achieved by virtue of plate 28 blocking aperture 30 to line 31 (which feeds the inlet side of piston 13) when the spool 18 is biased to is extreme left hand position as shown in eg. FIG. 2.

Spool 18 shown in the drawings is of a per se known design. Any of a number of equivalent devices may be employed, if appropriate, as alternatives to spool 18.

The circuit is arranged to provide maximum pump output pressure if the electrical supply to the solenoid actuated proportional control valve 16 is lost or corrupted. This is the inverse of normal control modes, and is achieved via the following operational sequence:

When there is no fluid at control pressure in the circuit, eg. because the control valve 16 is set to zero or because the electrical power thereto has failed, piston 20 is biased to its left hand position (maximum extension) by virtue of spring 25. This sets pressure compensator 17 to the configuration shown in FIG. 1, ie. so that the inlet side of piston 13 is connected to tank via drain line D, and the supply of fluid at outlet pressure via line 19 is blocked. Since piston 13 is connected to tank, spring 14 causes piston 13 to retract fully thereby giving rise to a maximum output pressure in the pump 11. When the output pressure reaches its maximum, the pump flow adjusts according to the load requirement.

As the pressure in line 12 increases (with increasing loading of the pump 11), the outlet pressure in line 29 also increases until the force acting on plate 28 overcomes the force provided by spring 25 which acts, via piston 20, against the free end 24 of spool 18. Consequently, spool 18 moves to the right of FIG. 1, connecting line 19 to the inlet side of piston 13, and supplying fluid at outlet pressure thereto. This causes extension of piston 13 against spring 14. This in turn causes a reduction in the pump output pressure.

If the loading on pump 11 decreases, the reverse sequence occurs to retract piston 13 and thereby increase the pump output pressure. Thus, the circuit functions as a regulator of the pump output. The circuit supplies a regulated output at all times, regardless of whether there is electrical power for the control valve 16.

When power is supplied to the control valve 16, fluid at control pressure is applied to the left hand side of piston 20 via line 26. This acts against the force of spring 25, with the result that outlet pressure in line 29 is sufficient to move spool 18 to the right, thereby connecting outlet pressure in line 19 to the inlet side of piston 13. This again causes extension of piston 13, thereby reducing the pump output. Thus it is possible to reduce the pump output from its regulated maximum by a predetermined amount according to the setting of the proportional control of valve 16.

When control valve 16 is configured as a proportional valve, it includes or is operatively associated with a constant flow valve 32 necessary to stabilise the flow to it.

As mentioned hereinabove, the control action of the preferred circuit could be inverted eg. by the use of a different form of control piston 13 that is biased in the opposite direction and in which fluid at outlet pressure acts to retract rather than extend the piston.

Figure 3:
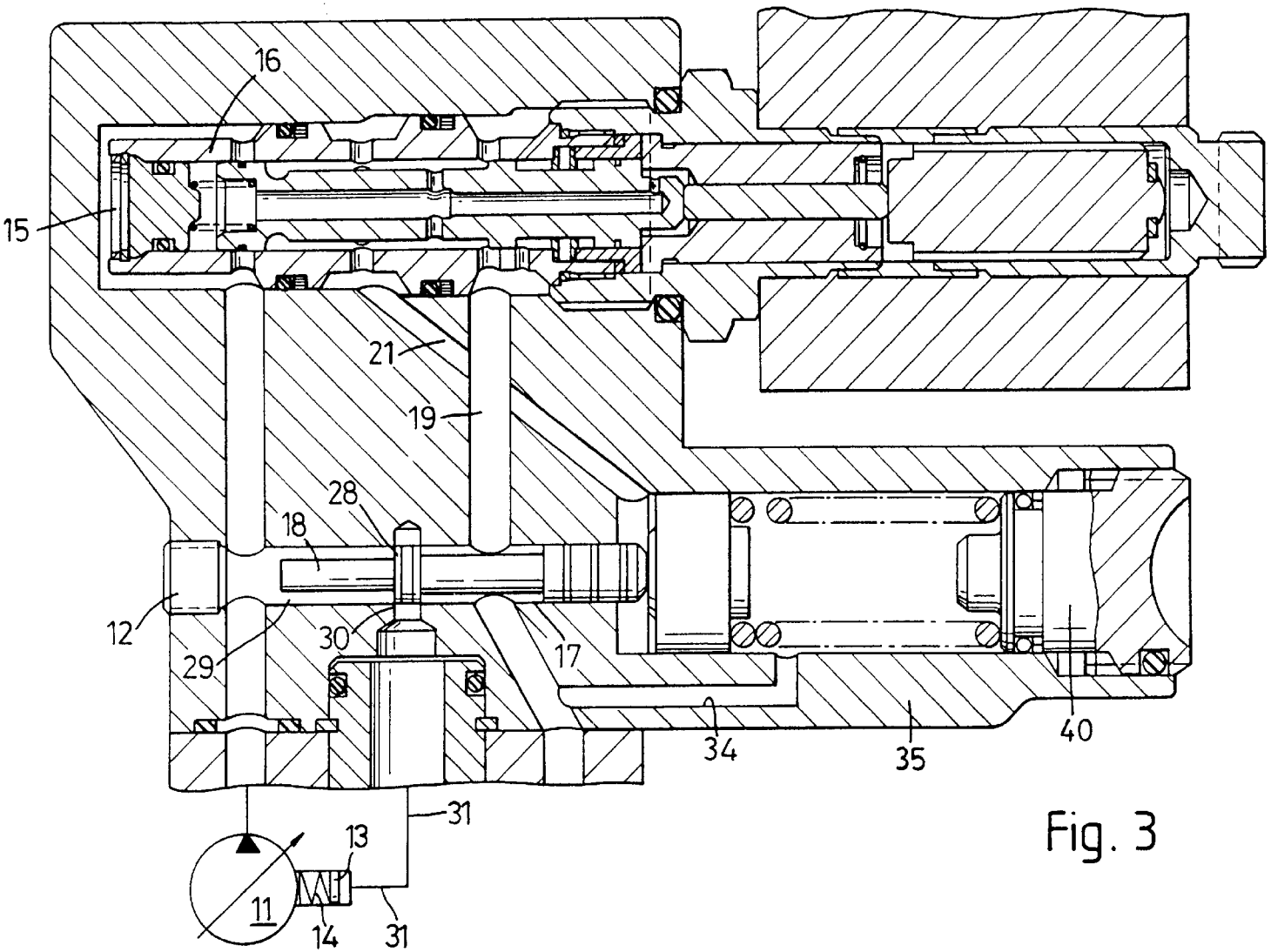
FIG. 3 is a cross-sectional view of a second embodiment of the invention, showing modifications from the FIG. 2 arrangement.

FIGS. 2 and 3 show practical embodiments of the invention. In the FIG. 2 embodiment, the side of piston 20 adjacent spring 25 is connected to tank via line 34. This ensures that the fluid pressures opposing the action of spring 25 do not have to accommodate (uncalibrated) pressures caused by compression of fluid on the right hand side of piston 20.

Also, the portion of bore 23 to the right of plate 28 is connected to drain line D. This allows spool 18 to open line 31 to drain when there is no pressure in the pump 11. The valve 16 of FIG. 2 is a proportional control valve. The end of the spool 15 constantly receives fluid from valve 32, and counteracts it. Thus the control pressure arises in line 26, in dependence on the solenoid force in valve 16 and the pin area over which such pressure acts.

The embodiment of FIG. 3 is similar to that of FIG. 2, except that it employs a pressure reducing valve, instead of the proportional control valve of FIG. 2.

In the pressure reducing valve, the controlled pressure acts on the end of the spool 15, against the solenoid force. If the pressure is insufficient to counter the solenoid force, the spool 15 moves to the left in FIG. 3 and via line 21 connects the pump outlet to the left hand side of piston 20. Pump output pressure is also supplied to the end of spool 15 via suitable drilled holes.

As the pump output pressure grows, in accordance with the operational sequence described above, it balances the solenoid force so that spool 15 closes. This maintains the pressure at the left hand side of piston 20, so that the circuit is balanced.

If the pump output pressure exceeds the solenoid force, the spool 15 moves to allow the controlled pressure to drain to tank, via line 19, until a new balance is achieved.

Valve 32 is not needed in the FIG. 3 embodiment.

As is evident from FIGS. 2 and 3, a circuit according to the invention may readily be manufactured as a compact device in which only the pump, control piston 13 and load are external to a common housing 35.

The circuit of the invention may be configured in numerous ways. For example, in some embodiments the piston 20 could be dispensed with as a separate item, and could instead be formed integrally with spool 18.

Also, the control valve 16 need not necessarily be a solenoid actuated valve.

We claim:

1. A fluid power control circuit, comprising:

a pump, connectable to supply fluid at outlet pressure to a load;

an adjustable control device capable of supplying control fluid in the circuit;

a biased fluid-actuated adjuster for adjusting the output of the pump; and a pressure-actuated directional controller for operatively supplying fluid at outlet pressure to the adjuster, wherein:

i) the directional controller is biased to disconnect fluid at outlet pressure from the adjuster;

ii) fluid at outlet pressure acts on the directional controller to counter said bias; and iii) control fluid in the circuit acts on the directional controller to counter said bias, in such away that fluid at outlet pressure is supplied to the adjuster, thereby tending to overcome its bias, when the aggregate effect of fluid at outlet pressure and control fluid on the directional controller exceeds its bias, so that in the absence of power for the adjustable control device the fluid-actuated adjuster adopts a position determined by its bias.

2. A circuit according to claim 1 wherein the supply of fluid at outlet pressure to the fluid-actuated adjuster causes the adjuster to decrease the outlet pressure of the pump.

3. A circuit according to claim 1 wherein the directional controller is a pressure compensator including a moveable spool.

4. A circuit according to claim 1 wherein the directional controller is a pressure compensator including a moveable spool and the circuit includes resilient biassing means biassing the spool to disconnect the fluid at outlet pressure from the adjuster.

5. A circuit according to claim 1 wherein the directional controller is a pressure compensator including a moveable spool and fluid at outlet pressure acts on the spool against the bias of the directional controller to disconnect fluid at outlet pressure from the adjuster.

6. A circuit according to claim 1 wherein the directional controller is a pressure compensator including a moveable spool and the directional controller includes a first, moveable surface against which control fluid in the circuit may act against the bias of the directional controller to disconnect fluid at outlet pressure from the adjuster, the moveable surface being drivingly engageable with the spool.

7. A circuit according to claim 1 wherein the directional controller is a pressure compensator including a moveable spool; the circuit includes resilient biassing means biassing the spool to disconnect the fluid at outlet pressure from the adjuster; and the directional controller includes a first, moveable surface against which control fluid in the circuit may act against the bias of the directional controller to disconnect fluid at outlet pressure from the adjuster, the moveable surface being drivingly engageable with the spool; the directional controller including a moveable piston defining the first, moveable surface at one side thereof, said side of the piston being drivingly engageable with the spool; and the resilient biassing means acting on the opposite side of the piston.

8. A circuit according to claim 1 wherein the directional controller is a pressure compensator including a moveable spool and fluid at outlet pressure acts on the spool against the bias of the directional controller to disconnect fluid at outlet pressure from the adjuster, the spool including a further surface against which acts fluid at outlet pressure.

9. A circuit according to claim 1 wherein the control device is a proportional control valve.

10. A circuit according to claim 1 wherein the directional controller is a proportional device.

11. A pressure control apparatus including a circuit according to claim 1.

12. A pressure control apparatus including a circuit according to claim 1, when configured as a fan or pump motor control apparatus.

13. A circuit according to claim 1 including a flow restrictor connected in series with the adjustable control device.

14. A fluid power control circuit, comprising:

an adjustable control device connected to supply control fluid in the circuit;

a pump, connectable to supply fluid at outlet pressure to a load;

a biased, fluid-actuated adjuster for adjusting the output of the pump; and a pressure-actuated directional controller for supplying fluid to the adjuster, wherein the directional controller includes a bias, wherein fluid at outlet pressure and control fluid are connectable to counter the bias of the directional controller; and wherein the directional controller is connected in series between the pump outlet and the adjuster to influence the direction of movement of the adjuster against its bias when the aggregate effect of fluid at outlet pressure and control fluid exceeds the bias of the directional controller.

15. A circuit according to claim 14 including a flow restrictor connected in series with the adjustable control device.

* * * * *